US007096603B2

(12) United States Patent
Fusco

(10) Patent No.: US 7,096,603 B2
(45) Date of Patent: Aug. 29, 2006

(54) ARTICLE INCORPORATING AN ILLUSIONARY STRUCTURE

(75) Inventor: Ciro Fusco, Portland, OR (US)

(73) Assignee: Nike, Inc., Beaverton, OR (US)

( * ) Notice: Subject to any disclaimer, the term of this patent is extended or adjusted under 35 U.S.C. 154(b) by 83 days.

(21) Appl. No.: 11/007,050

(22) Filed: Dec. 8, 2004

(65) Prior Publication Data

US 2006/0117604 A1 Jun. 8, 2006

(51) Int. Cl.
*A43B 13/00* (2006.01)

(52) U.S. Cl. ..... 36/25 R; 36/103; 36/1

(58) Field of Classification Search ..... 36/1, 36/137, 103, 25 R; 2/115, 244, 77, 69; D2/946, D2/956, 958, 972, 977
See application file for complete search history.

(56) References Cited

U.S. PATENT DOCUMENTS 3,114,981 A * 12/1963 Murawski ..... 36/83
3,312,583 A * 4/1967 Rochlis ..... 428/88
5,224,810 A * 7/1993 Pitkin ..... 36/30 R
D377,109 S * 1/1997 Manfredi ..... D2/957
D461,628 S * 8/2002 Neely et al. ..... D2/972
6,843,578 B1 1/2005 Cheung
D509,346 S * 9/2005 Recchi ..... D2/959
D518,280 S * 4/2006 Matis et al. ..... D2/957

* cited by examiner

*Primary Examiner*—Ted Kavanaugh
(74) *Attorney, Agent, or Firm*—Banner & Witcoff, LTD

(57) ABSTRACT

An article of equipment or apparel, such as footwear, is disclosed that includes an exterior surface having misleading depth cues that form a reverse perspective structure. The reverse perspective structure may have a three-dimensional configuration that includes a first edge and a second edge. The first edge is located closer to an interior of the article than the second edge, and the first edge has a greater length than the second edge. The reverse perspective structure may alternately or also include a pair of non-parallel perspective line edges with first ends and second ends. The first ends are located closer to the interior of the article than the second ends, and the first ends have a greater spacing than the second ends.

29 Claims, 6 Drawing Sheets

ARTICLE INCORPORATING AN ILLUSIONARY STRUCTURE

BACKGROUND OF THE INVENTION

1. Field of the Invention

The present invention relates to various articles, such as apparel and equipment. The invention concerns, more particularly, an article that includes an illusionary structure having the configuration of a reverse perspective. The invention has application to various types of athletic equipment and apparel, including footwear, for example.

2. Description of Background Art

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces (i.e., imparting cushioning), the sole structure may provide traction and control potentially harmful foot motion, such as over pronation. Accordingly, the upper and the sole structure operate cooperatively to provide a comfortable structure that is suited for a wide variety of ambulatory activities, such as walking and running. The general features and configuration of the upper and the sole structure are discussed in greater detail below.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

The sole structure generally incorporates multiple layers that are conventionally referred to as an insole, a midsole, and an outsole. The insole is a thin, compressible member located within the upper and adjacent the plantar (lower) surface of the foot to enhance footwear comfort. The midsole, which is traditionally attached to the upper along the entire length of the upper and formed from a polymer foam material, forms the middle layer of the sole structure and serves a variety of purposes that include controlling foot motions and providing cushioning. The outsole forms the ground-contacting element of footwear and is usually fashioned from a durable, wear-resistant material that includes texturing to improve traction.

Based upon the above discussion, the upper and sole structure operate cooperatively to receive the foot and enhance the comfort of walking, running, or other ambulatory activities. Although the configuration of the upper and sole structure each provide functional benefits to the wearer through their respective structures, the exterior surface of each of the upper and sole structure are generally designed to promote the aesthetic appeal of the footwear. That is, the exterior surface of many articles of footwear serve the purpose of enhancing the aesthetic appeal of the footwear.

This may be accomplished through color schemes, textures, and designs that are incorporated into the exterior surface.

SUMMARY OF THE INVENTION

The present invention relates to illusionary structures that are incorporated into various types of athletic equipment and apparel, including footwear. As discussed in the Background of the Invention section above, the exterior surface of many articles of footwear serve the purpose of enhancing the aesthetic appeal of footwear. In addition to enhancing the aesthetic appeal of footwear, illusionary structures incorporated into the exterior surface may also impart a competitive advantage to a wearer. That is, the illusionary structures may distract or otherwise interrupt the concentration of a competitor, thereby imparting the competitive advantage to the wearer during an athletic endeavor.

As an example, the invention may be an article of apparel with an exterior surface having misleading depth cues that form a reverse perspective structure. The reverse perspective structure may have a three-dimensional configuration that includes a first edge and a second edge. The first edge is located closer to an interior of the article than the second edge, and the first edge has a greater length than the second edge. The reverse perspective structure may alternately or also include a pair of non-parallel perspective line edges with first ends and second ends. The first ends are located closer to the interior of the article than the second ends, and the first ends have a greater spacing than the second ends. The first edge and the second edge may have a configuration that forms a first of the misleading depth cues, and the perspective line edges may have a configuration that forms a second of the misleading depth cues.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Introduction

The following discussion and accompanying figures disclose an article in accordance with the present invention. Concepts related to the article are disclosed with reference to an article of footwear 10 having a general configuration that is suitable for athletic activities. The invention is not solely limited to athletic footwear and may also be applied to footwear styles that are generally considered to be non-athletic, including dress shoes, loafers, sandals, and work boots, for example. In addition, one skilled in the relevant art will appreciate that the concepts disclosed herein apply to a wide variety of articles, such as other forms of apparel (i.e., shirts, hats, pants, shorts, etc.) and athletic equipment. Accordingly, the concepts may be applied to a wide range of articles, in addition to footwear 10.

Figure 1:
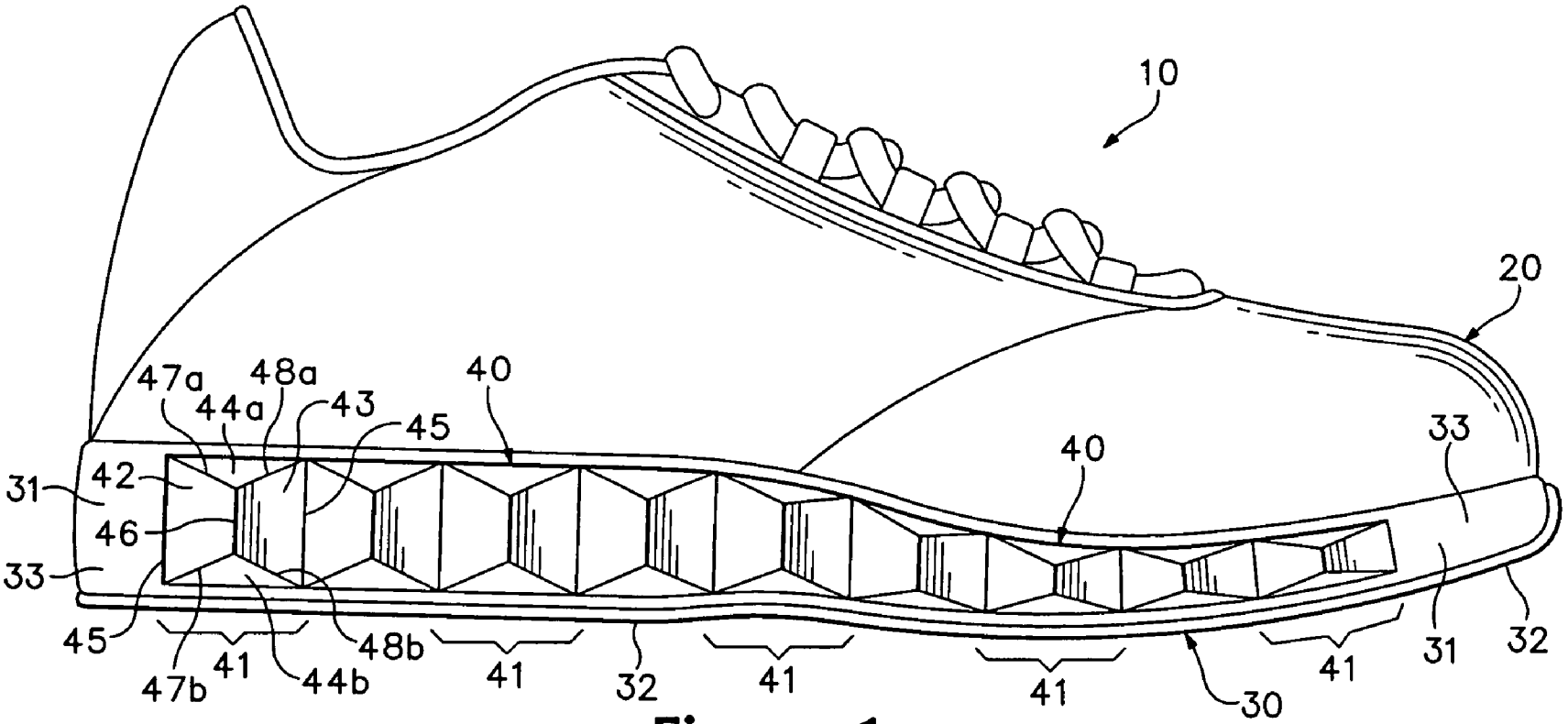
FIG. 1 is a lateral elevational view of an article of footwear having a sole structure in accordance with the present invention.
Figure 2:
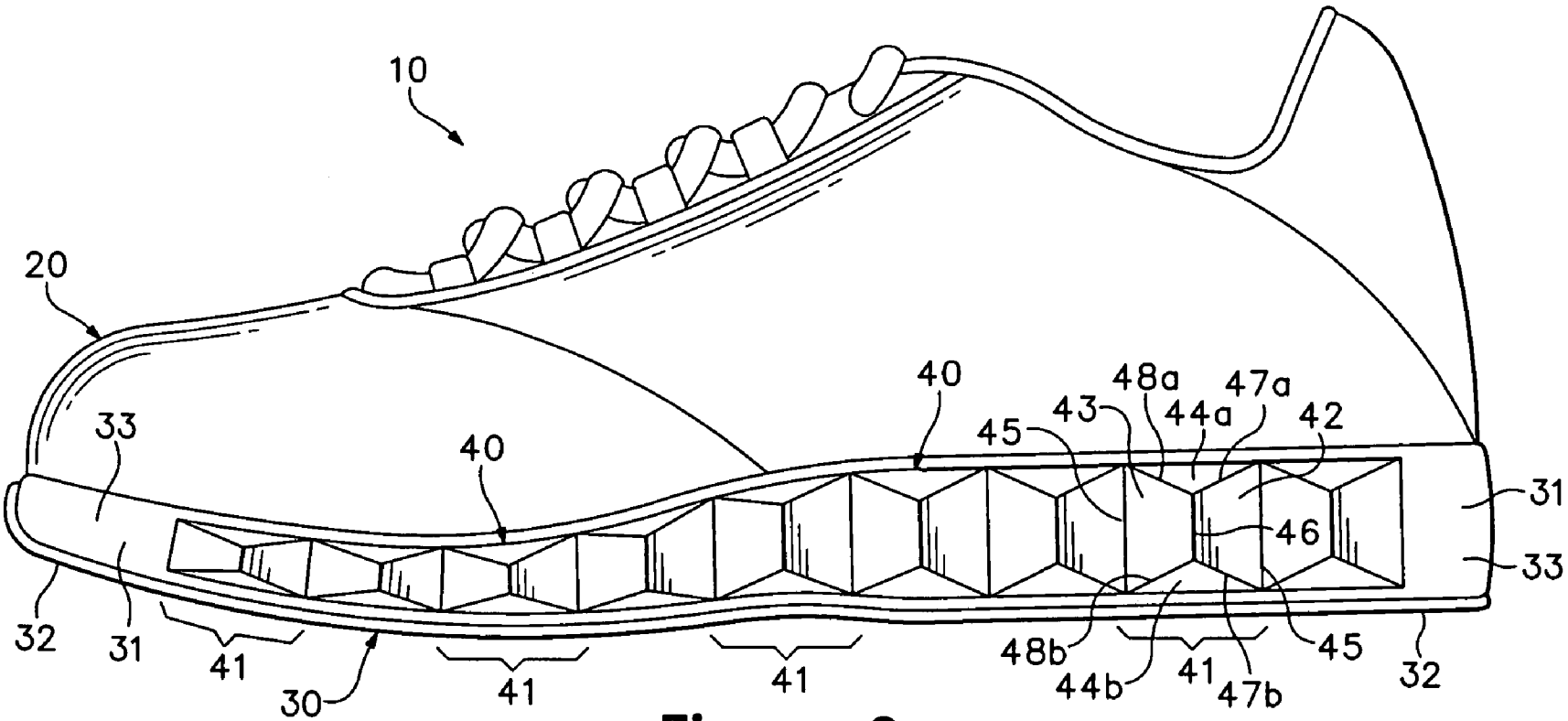
FIG. 2 is a medial elevational view of the article of footwear.

Footwear 10 is depicted in FIGS. 1 and 2 as including an upper 20 and a sole structure 30. Upper 20 has a substantially conventional configuration and includes a plurality elements, such as textiles, foam, and leather materials, that are stitched or adhesively bonded together to form an interior void for securely and comfortably receiving the foot. Sole structure 30 is positioned below upper 20 and includes two primary elements, a midsole 31 and an outsole 32. Midsole 31 is secured to a lower surface of upper 20, through stitching or adhesive bonding for example, and operates to attenuate ground reaction forces (i.e., provide cushioning) as sole structure 30 impacts the ground. Midsole 31 may also absorb energy as sole structure 30 is compressed between the foot and the ground during walking or running, for example. Outsole 32 is secured to a lower surface of midsole 31 and is formed of a durable, wear-resistant material that is suitable for engaging the ground. In addition, sole structure 30 may include an insole (not depicted), which is a thin, compressible member located within the void and adjacent to a plantar surface of the foot to enhance the comfort of footwear 10.

Midsole 31 is primarily formed of a polymer foam material, such as polyurethane or ethylvinylacetate, and may encapsulate a fluid-filled bladder. An upper surface of midsole 31 is secured to upper 20, and an opposite lower surface of midsole 31 is secured to outsole 32. As depicted in each of FIGS. 1–7, midsole 31 defines an exposed side surface 33 that incorporates an illusionary structure 40. Each of side surface 33 and illusionary structure 40 are visible from each of the lateral and medial sides of footwear 10. In other words, side surface 33 and illusionary structure 40 would be visible to a competitor, for example, when footwear 10 is worn by a wearer. As described in greater detail below, illusionary structure 40 may impart a competitive advantage to the wearer. That is, illusionary structure 40 may distract or otherwise interrupt the concentration of the competitor, thereby imparting a competitive advantage to the wearer during an athletic endeavor.

The Illusionary Structure

Illusionary structure 40 is recessed into side surface 33 and has a three-dimensional configuration formed from various intersecting faces that define edges, as depicted in each of FIGS. 3–7. The overall height of illusionary structure 40 decreases as illusionary structure 40 extends between the heel region and the forefoot region of footwear 10 in order to accommodate a decreasing thickness in sole structure 30. In other embodiments of the invention, illusionary structure 40 may extend outward from side surface 33, or illusionary structure 40 may have a constant height. Furthermore, illusionary structure 40 may extend around the heel region and forefoot region of footwear 10. Although illusionary structure 40 is depicted as being incorporated into sole structure 30, illusionary structure 40 may also be incorporated into upper 20 or a combination of both upper 20 and sole structure 30. In addition to footwear 10, illusionary structure 40 may also be incorporated into other forms of apparel (i.e., shirts, hats, pants, shorts, etc.) and various types of athletic equipment. Accordingly, the configuration of illusionary structure 40 and the manner in which illusionary structure 40 is incorporated into articles may vary considerably within the scope of the present invention.

Figure 3:
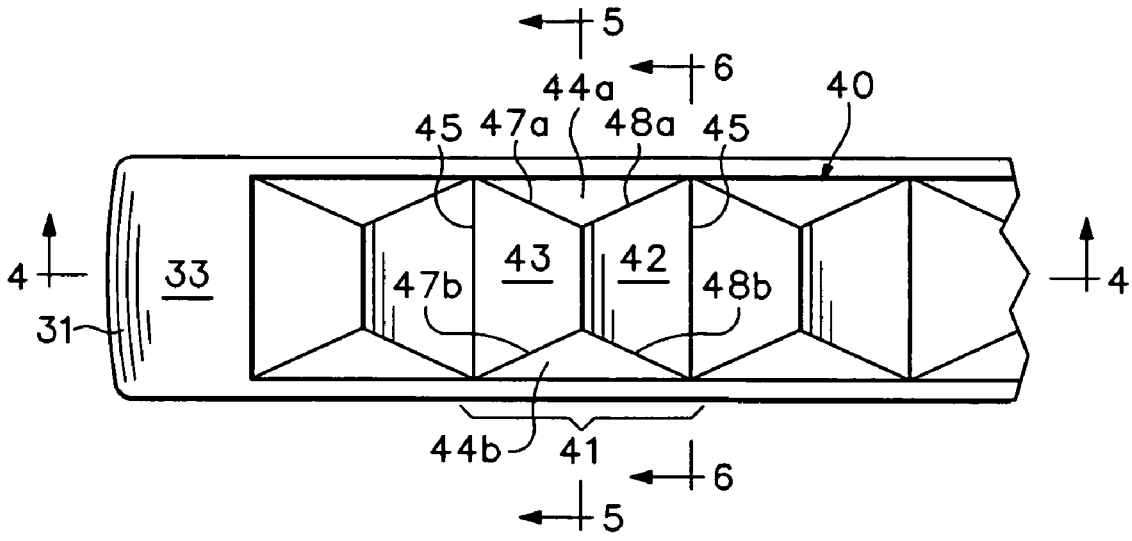
FIG. 3 is a partial lateral elevational view of a portion of the sole structure.
Figure 4:
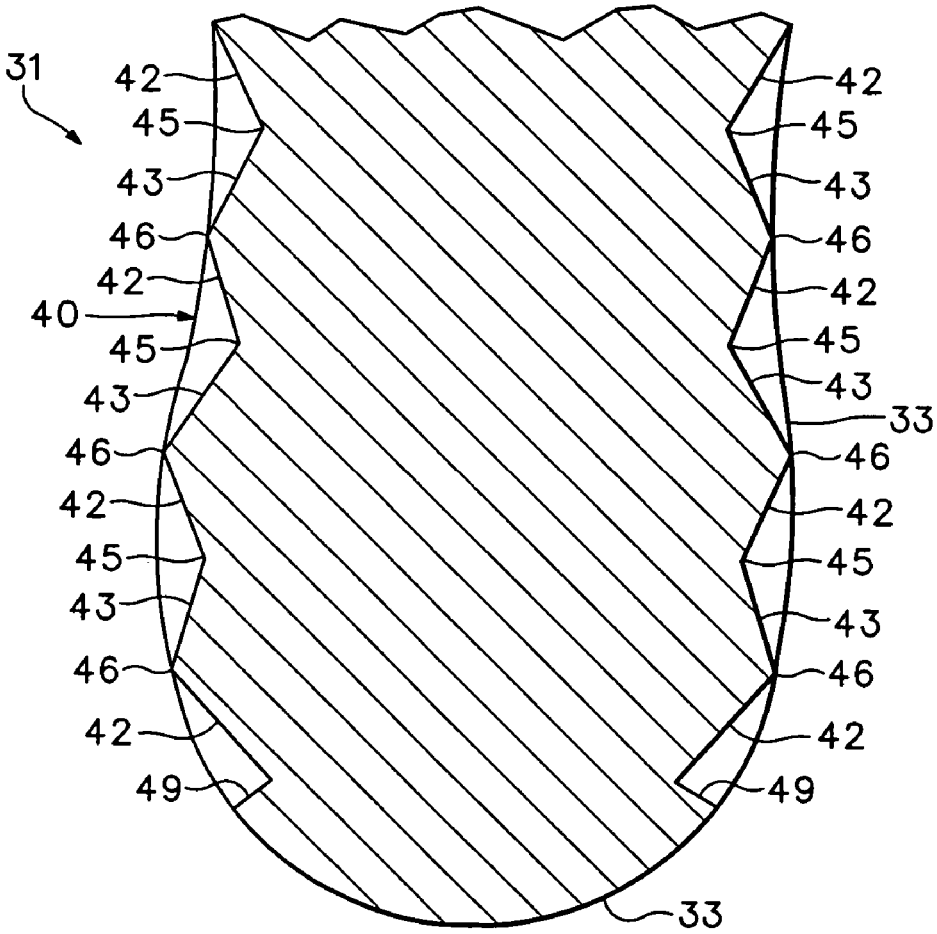
FIG. 4 is a first cross-sectional view of the portion of the sole structure, as defined by section line 4—4 in FIG. 3.
Figure 5:
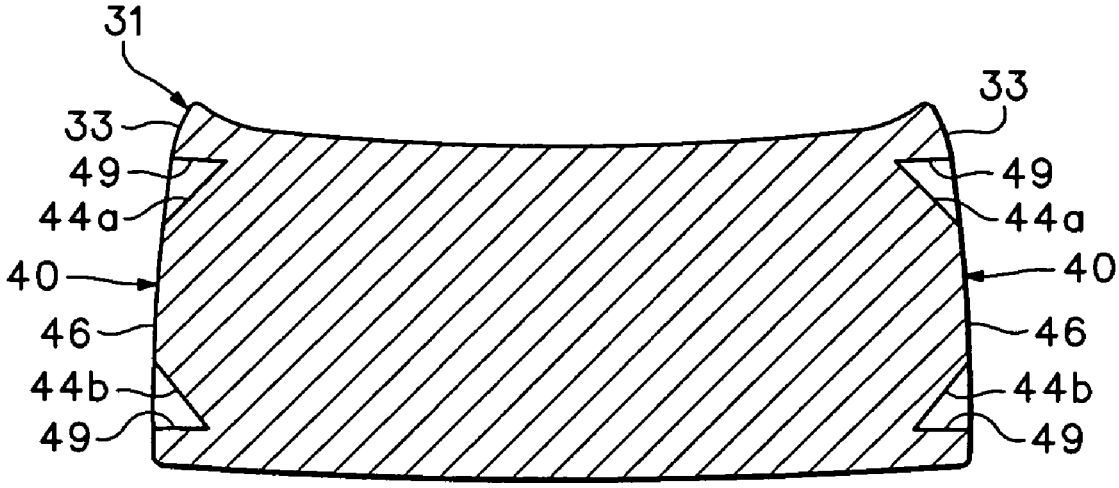
FIG. 5 is a second cross-sectional view of the portion of the sole structure, as defined by section line 5—5 in FIG. 3.
Figure 6:
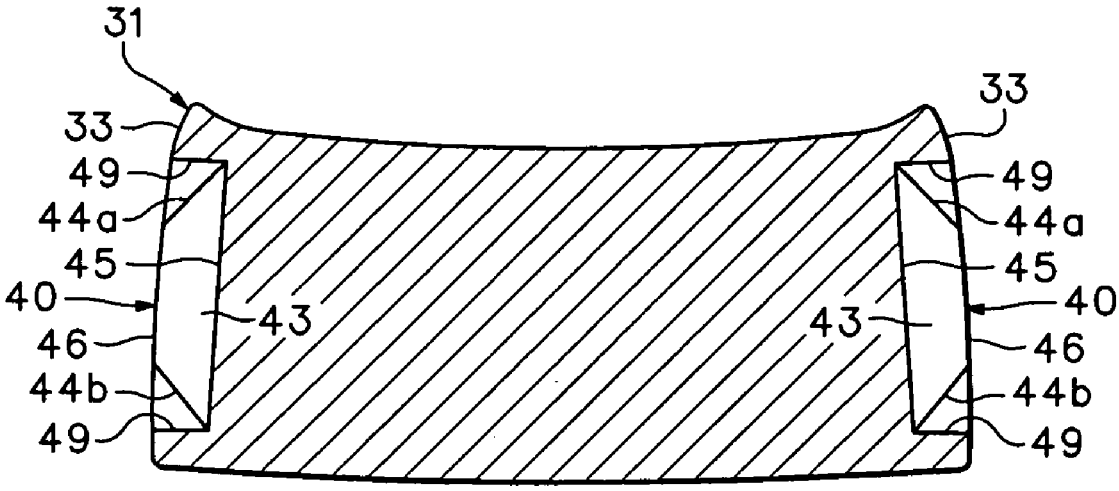
FIG. 6 is a third cross-sectional view of the portion of the sole structure, as defined by section line 6—6 in FIG. 3.
Figure 7:
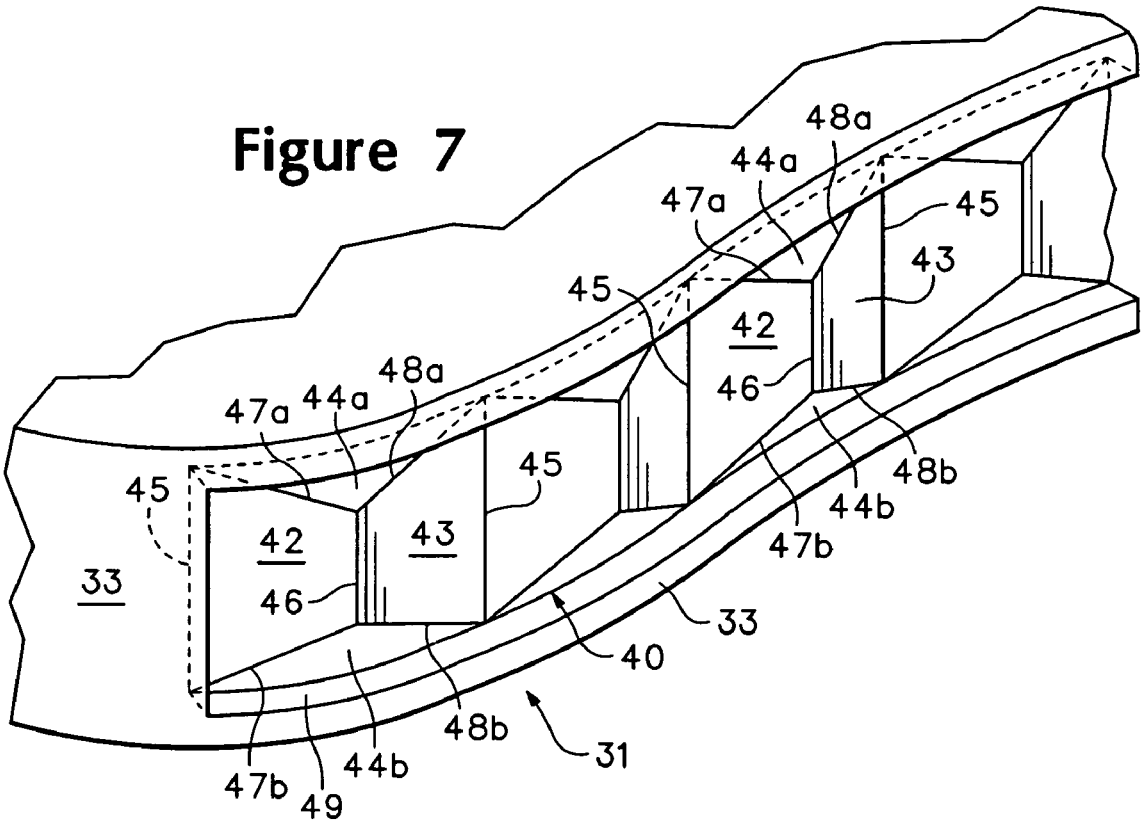
FIG. 7 is a perspective view of the portion of the sole structure depicted in FIG. 3.

Illusionary structure 40 forms a repeating pattern along the length of sole structure 30. The repeating pattern is effectively formed from a plurality of units 41 that are located side-by-side along the length of sole structure 30, as depicted in FIG. 3. Each unit 41 includes a first face 42, a second face 43, an upper face 44*a*, a lower face 44*b*, a pair of long edges 45 that are cooperatively formed with adjacent units 41, a short edge 46, a first pair of perspective line edges 47*a* and 47*b*, and a second pair of perspective line edges 48*a* and 48*b*.

First face 42 and second face 43 extend vertically and have generally trapezoidal shapes that are mirror images of each other. Each of faces 42 and 43 are angled with respect to side surface 33 and extend into sole structure 30. Whereas first face 42 is angled toward the heel region of footwear 10, second face 43 is angled toward the forefoot region of footwear 10. The angles between first face 42 and second face 43 cooperatively form, therefore, a v-shaped configuration with short edge 46 being the vertex of the v-shaped configuration, as depicted in the cross-section of FIG. 4. Given that numerous units 41 are located side-by-side, the plurality of first faces 42 and second faces 43 form a zig-zag structure that is also depicted in the cross-section of FIG. 4. Consistently, therefore, the angled configuration of first faces 42 and second faces 43 form a plurality of wedge-shaped indentations in side surface 33.

First face 42 is bounded by long edge 45, short edge 46, and both of perspective line edges 47*a* and 47*b*. Each of edges 45, 46, 47*a*, and 47*b* are formed at the intersection of first face 42 and various other faces that are adjacent to first face 42. More particularly, (a) one of long edges 45 is formed at the intersection of first face 42 and a second face 43 from an adjacent unit 41, (b) short edge 46 is formed at the intersection of first face 42 and second face 43 (i.e., the second face 43 that is from the same unit 41 as first face 42), (c) perspective line edge 47*a* is formed at the intersection of first face 42 and upper face 44*a*, and (d) perspective line edge 47*b* is formed at the intersection of first face 42 and lower face 44*b*. The side of first face 42 that forms short edge 46 is substantially located on the plane of side surface 33, as depicted in the cross-section of FIG. 5. The side of first face 42 that is positioned opposite short edge 46 and forms long edge 45 is recessed into midsole 31 and is, therefore, spaced inward from the plane of side surface 33, as depicted in the cross-section of FIG. 6. In other words, long edge 45 is located closer to an interior of footwear 10 than short edge 46. In some embodiments of the invention, illusionary structure 40 may protrude from side surface 33, with long edge 45 remaining in a location that is closer to an interior of footwear 10 than short edge 46

Second face 43 has a configuration that is substantially similar to first face 42. Second face 43 is bounded by long edge 45, short edge 46, and both of perspective line edges 48*a* and 48*b*. Each of edges 45, 46, 48*a*, and 48*b* are formed at the intersection of second face 43 and various other faces that are adjacent to second face 43. More particularly, (a) another one of long edge 45 (i.e., the other long edge 45 that is in unit 41) is formed at the intersection of second face 43 and a first face 42 from an adjacent unit 41, (b) short edge 46 is formed at the intersection of second face 43 and first face 42, as discussed above, (c) perspective line edge 48*a* is formed at the intersection of second face 43 and upper face 44*a*, and (d) perspective line edge 48*b* is formed at the intersection of second face 43 and lower face 44*b*. The side of second face 43 that forms short edge 46 is substantially located on the plane of side surface 33. The side of second face 43 that is positioned opposite short edge 46 and forms long edge 45 is recessed into midsole 31 and is, therefore, spaced inward from the plane of side surface 33. As in the discussion above, long edge 45 is located closer to an interior of footwear 10 than short edge 46, but illusionary structure 40 may protrude from side surface 33 in some embodiments of the invention.

Upper face 44*a* and lower face 44*b* have generally triangular shapes that are mirror images of each other. Each of faces 44*a* and 44*b* are angled with respect to a horizontal plane and extend into sole structure 30. Whereas first face 42 is angled to face upward, second face 43 is angled to face downward, as depicted in the cross-section of FIG. 5.

Upper face 44*a* is bounded by each of perspective line edges 47*a* and 48*a*. In addition, a rearward edge of upper face 44*a* intersects a recessed surface 49 that extends into midsole 31 from side surface 33. More particularly, and as described above, (a) perspective line edge 47*a* is formed at the intersection of first face 42 and upper face 44*a*, and (b) perspective line edge 48*a* is formed at the intersection of second face 43 and upper face 44*a*. Perspective line edges 47*a* and 48*a* intersect at an upper end of short edge 46. Accordingly, each of short edge 46 and perspective line edges 47*a* and 48*a* share a common end point that is on the plane of side surface 33. Opposite ends of perspective line edges 47*a* and 48*a* each intersect and share a common end point with one of long edges 45. Accordingly, the opposite ends of perspective line edges 47*a* and 48*a* are recessed into midsole 31 and are spaced inward from the plane of side surface 33.

Lower face 44*b* has a configuration that is substantially similar to upper face 44*a*. Lower face 44*b* is bounded by each of perspective line edges 47*b* and 48*b*. In addition, a rearward edge of lower face 44*b* intersects another recessed surface 49 that extends into midsole 31 from side surface 33. More particularly, and as described above, (a) perspective line edge 47*b* is formed at the intersection of first face 42 and lower face 44*b*, and (b) perspective line edge 48*b* is formed at the intersection of second face 43 and lower face 44*b*. Perspective line edges 47*b* and 48*b* intersect at a lower end of short edge 46. Accordingly, each of short edge 46 and perspective line edges 47*b* and 48*b* share a common end point that is on the plane of side surface 33. Opposite ends of perspective line edges 47*b* and 48*b* each intersect and share a common end point with one of long edges 45. Accordingly, the opposite ends of perspective line edges 47*b* and 48*b* are recessed into midsole 31 and are spaced inward from the plane of side surface 33.

Based upon the above discussion and a review of the figures, each unit 41 is a four-sided structure (i.e., the four faces 42, 43, 44*a*, and 44*b*) that is recessed into midsole 31 and protrudes outward to form short edge 46. Each unit 41 is similar, therefore, to a pyramid where the vertex of the pyramid is formed from a generally linear edge (i.e., short edge 46) rather than a point. Multiple units 41 are located side-by-side along the length of sole structure 30, and long edges 45 form the interface between adjacent units 41. Whereas the various short edges 46 are located on the plane of side surface 33, long edges 45 are recessed into midsole 31 and are, therefore, spaced inward from side surface 33. In other embodiments of the invention, however, long edges 45 may be located on the plane of side surface 33, and short edges 46 may protrude outward from midsole 31. Accordingly, the positions of long edges 45 and short edges 46 relative to midsole 31 may vary considerably. In general, however, long edges 45 are recessed rearward from short edges 46 such that each unit effectively forms the generally pyramidal structure described above, wherein a point vertex is replaced with a generally linear edge (i.e., short edge 46).

Illusionary structure 40 forms a repeating pattern along the length of sole structure 30, as discussed above. The repeating pattern is effectively formed from the plurality of units 41, which are located side-by-side along the length of sole structure 30. With the exception of the first face 42 that is at an end of the repeating pattern, each first face 42 is positioned between two second faces 43. Similarly, each second face 43 is positioned between two first faces 42, with the exception of the second face 43 that is at an opposite end of the repeating pattern. As depicted in any of FIGS. 1–3, the various perspective line edges 47*a* and 48*a* are aligned end-to-end and form a zig-zag configuration along the length of sole structure 30. The locations where adjacent perspective line edges 47*a* and 48*a* meet form vertices, and one of long edge 45 and short edge 46 extends vertically downward from the vertices. Similarly, the various perspective line edges 47*b* and 48*b* are aligned end-to-end and also form a zig-zag configuration along the length of sole structure 30. In locations where adjacent perspective line edges 47*b* and 48*b* meet and form vertices, one of long edge 45 and short edge 46 extends vertically upward from the vertices.

Depth Perception

The human mind perceives depth based upon the relationships of various depth cues. Examples of depth cues include the relative sizes of one or more objects (or portions thereof) and the spatial relationships between perspective lines associated with the one or more objects. In other words, relative sizes of an object and perspective lines associated with the object operate in conjunction to impart the impression of depth. These concepts will be discussed in greater detail with reference to FIG. 8, in which a cube 50 is depicted in a three-dimensional manner.

Figure 8:
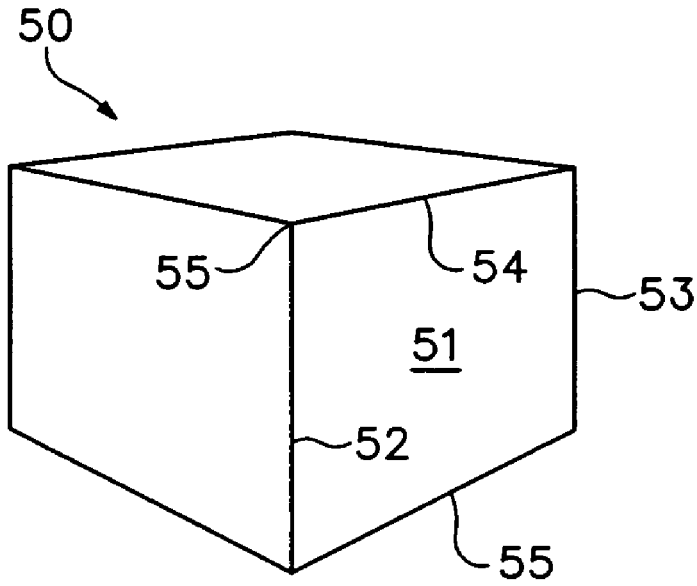
FIG. 8 is a two-point perspective view of a cube.

Cube 50 is composed of six square faces that are arranged to define eight vertices and twelve edges. The six faces are planar surfaces on the exterior of cube 50. The eight vertices form points in corners of cube 50 where three individual faces meet. In addition, the twelve edges form right angles at the intersection of two individual faces. With reference to FIG. 8, a face 51 is bounded by four edges 52–55. Edges 52 and 53 extend in a vertical direction and are positioned on opposite sides of face 51. Edges 54 and 55 extend respectively along upper and lower portions of face 51.

Based upon a review of FIG. 8, the human mind perceives edge 52 as being closest to the individual viewing cube 50, and edge 53 appears to be further from the individual than edge 52. From a geometrical standpoint, the edges that define an individual face of a cube have equal lengths. Edge 52, however, is not physically drawn as having the same length as edge 53. More particularly, edge 52 is drawn to have a greater length than edge 53. Accordingly, one manner in which the human mind perceives depth in FIG. 8 relates to the relative sizes (i.e., lengths) of edges 52 and 53. That is, the disparity between the length of edge 52 and the length of edge 53 provides a depth cue that imparts the perception of depth in FIG. 8.

Another depth cue that imparts the perception of depth in FIG. 8 is the spatial relationships between perspective lines associated with cube 50. Edges 54 and 55 extend between end points of edges 52 and 53. From a geometrical standpoint, the edges formed at opposite sides of an individual face of a cube are parallel to each other. Edges 54 and 55, however, are not physically drawn as being parallel to each other. Rather, edges 54 and 55 are drawn as converging in the distance between edge 52 and edge 53. Accordingly, another manner in which the human mind perceives depth in FIG. 8 relates to the spatial relationships (i.e., convergence) of edges 54 and 55. That is, the non-parallel property of edges 54 and 55 provides a depth cue that also imparts the perception of depth in FIG. 8.

Figure 9:
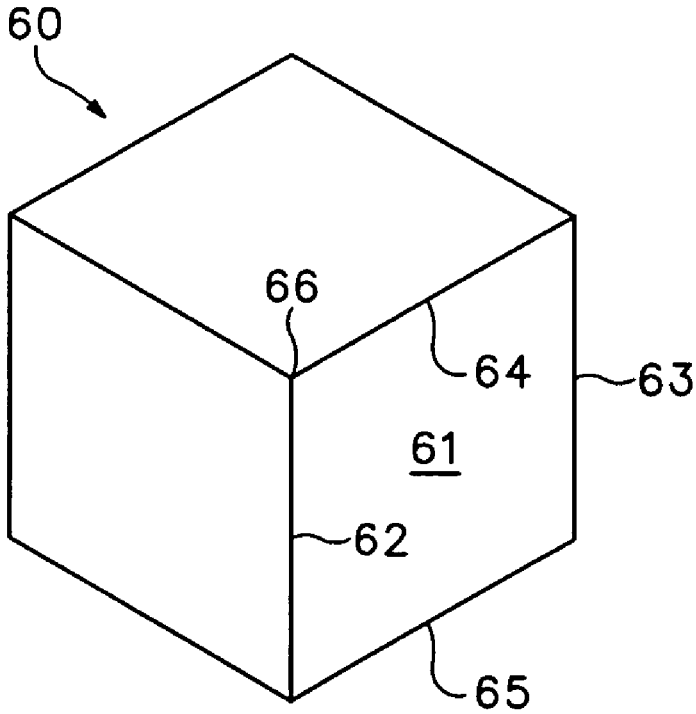
FIG. 9 is an isometric view of a composition.

In order to illustrate a contrast with FIG. 8, a composition 60 is depicted in FIG. 9 that does not incorporate the various depth cues of cube 50. Composition 60 is also composed of six square faces that are arranged to define eight vertices and twelve edges. A face 61 is bounded by four edges 62–65. Edges 62 and 63 extend in a vertical direction and are positioned on opposite sides of face 61. Edges 64 and 65 extend respectively along upper and lower portions of face 61. Although the human mind may perceive composition 60 as having the configuration of a cube, the human mind may also interpret FIG. 9 as depicting a corner, as in the corner of a room in an office or home. That is, a vertex 66 may be interpreted by the human mind as being closest to the individual viewing FIG. 9, or the human mind may interpret vertex 66 as being the point of composition 60 that is furthest from the individual.

The rationale for the possible dual interpretations of FIG. 9 relates to the absence of depth cues. In contrast with composition 60, cube 50 incorporated a disparity between the length of edge 52 and the length of edge 53, and also incorporated the non-parallel property of edges 54 and 55. These depth cues imparted the impression of depth in FIG. 8. FIG. 9, however, does not incorporate depth cues and is, therefore, perceptually-ambiguous with respect to depth.

Although the above discussion related to a two-dimensional drawing of a three-dimensional object, similar considerations apply to actual three-dimensional objects. For example, cube 50 could represent a structure, such as a building. When an individual views an actual structure, the perceived difference in lengths of various edges of the structure and the perceived non-parallel property of other lines operate as depth cues that indicate the relative positions of portions of the structure. Accordingly, the various depth cues that imparted the impression of depth in FIG. 8 also operate to provide information as to the depth of actual three-dimensional objects. As described in greater detail below, however, illusionary structure 40 incorporates misleading depth cues.

Reverse Perspective

The above depth perception discussion outlines two ways in which the impression of depth may be imparted to a two-dimensional or three-dimensional object. More particularly, (1) relative sizes of one or more objects (or portions thereof) and (2) perspective lines associated with the one or more objects may be utilized individually or in conjunction to impart the impression of depth.

Illusionary structure 40 incorporates edges of different relative sizes (i.e., long edge 45 and short edge 46). Based upon the above depth perception discussion, the human mind tends to interpret long edge 45 as being closer to the individual than short edge 46. That is, the relative sizes of long edge 45 and short edge 46 impart the impression that short edge 46 is further from the individual than long edge 45. As discussed above, however, short edge 46 is actually closer to the individual than long edge 45.

Illusionary structure 40 also incorporates pairs of perspective lines (i.e., perspective line edges 47*a* and 47*b* and perspective line edges 48*a* and 48*b*). Based upon the above depth perception discussion, the human mind tends to interpret converging perspective lines as extending away from the individual. Perspective line edges 47*a* and 47*b* converge in the distance between long edge 45 and short edge 46. Similarly, perspective line edges 48*a* and 48*b* converge in the distance between the other long edge 45 and short edge 46. When viewing illusionary structure 40, the individual would interpret the convergence of perspective line edges 47*a* and 47*b* as extending away from the individual. That is, the human mind would interpret the portions of perspective line edges 47*a* and 47*b* that are adjacent to short edge 46 as being further from the individual than the portions of perspective line edges 47*a* and 47*b* that are adjacent to long edge 45. As discussed above, however, the converged areas of perspective line edges 47*a* and 47*b*, which are adjacent to short edge 46, are actually closer to the individual than the areas adjacent to long edge 45. Similar considerations apply to perspective line edges 48*a* and 48*b*.

The configuration of illusionary structure 40 presents an optical illusion that is referred to as a reverse perspective. In general, a reverse perspective may be defined as an optical illusion wherein the relative sizes of an object (or portions thereof) and perspective lines associated with the object are utilized to impart a misleading impression of depth. In illusionary structure 40, the relative sizes of long edge 45 and short edge 46 are utilized to impart a misleading impression of depth. In addition, the convergence of perspective line edges 47*a*, 47*b*, 48*a*, and 48*b* at short edge 46 is also utilized to impart a misleading impression of depth. Accordingly, the relative sizes of long edge 45 and short edge 46 and the convergence of perspective line edges 47*a*, 47*b*, 48*a*, and 48*b* at short edge 46 form misleading depth cues that impart the configuration of a reverse perspective to illusionary structure 40.

The mind of an individual that views a reverse perspective interprets close portions as being further from the individual, and also interprets far portions as being close to the individual. This may be confirmed through a review of FIGS. 1–3, wherein long edges 45 of illusionary structure 40 appear to be closer than short edges 46. When a reverse perspective is moves side-to-side relative to the individual, or when the individual moves side-to-side relative to the reverse perspective, various faces associated with the reverse perspective appear to change in a contradictory manner.

Referring to illusionary structure 40, the individual will expect that first face 42 becomes more visible as the individual moves toward the heel region of footwear 10. In fact, however, first face 42 will become less visible. Similarly, the individual will expect that second face 43 will become less visible as the individual moves toward the heel region of footwear 10, when in fact second face 43 will become more visible. Similar concepts apply when the individual moves toward the forefoot region of footwear 10. Referring again to illusionary structure 40, the individual will expect that first face 42 becomes less visible as the individual moves toward the forefoot region of footwear 10. In fact, however, first face 42 will become more visible. Similarly, the individual will expect that second face 43 will become more visible as the individual moves toward the forefoot region of footwear 10, when in fact second face 43 will become less visible.

The seemingly contradictory changes in faces 42 and 43 have the potential to impart a competitive advantage to the wearer. That is, illusionary structure 40 may distract or otherwise interrupt the concentration of the competitor, thereby imparting a competitive advantage to the wearer during an athletic endeavor. When engaging in an athletic activity, the competitor may see footwear 10 and portions of illusionary structure 40. As the wearer moves footwear 10, or as the competitor moves relative to footwear 10, the seemingly contradictory changes in faces 42 and 43 may distract or otherwise interrupt the concentration of the competitor. More particularly, the misleading depth cues in illusionary structure 40 may operate to provide a competitive advantage when footwear 10 and the competitor move relative to each other.

The colors or differences in colors associated with various portions of illusionary structure 40 may be utilized to enhance the misleading depth cues. More particularly, the colors selected for each of faces 42, 43, 44*a*, and 44*b* and each of edges 45, 46, 47*a*, 47*b*, 48*a*, and 48*b* may add to the reverse perspective illusion associated with illusionary structure 40. For example, faces 42 and 43 may exhibit different colors to impart a visual distinction between faces 42 and 43. In addition, faces 44*a* and 44*b* may exhibit a different color than each of faces 42 and 43. In some embodiments, one or more of faces 42, 43, 44*a*, and 44*b* may be darker in areas that are adjacent to short edge 46 in order to facilitate the perception that short edge 46 is more recessed in side surface 33 than long edge 45. That is, faces 42, 43, 44*a*, and 44*b* may incorporate shading that enhances the misleading depth cues. Furthermore, edges 45, 46, 47*a*, 47*b*, 48*a*, and 48*b* may be colored to assist with distinguishing faces 42, 43, 44*a*, and 44*b* from edges 45, 46, 47*a*, 47*b*, 48*a*, and 48*b*. Accordingly, the selection of colors associated with illusionary structure 40 may enhance the misleading depth cues associated with illusionary structure 40, thereby facilitating the competitive advantage to the wearer.

Conclusion

Although illusionary structure 40 is depicted as being incorporated into sole structure 30, illusionary structure 40 may also be incorporated into upper 20 or a combination of both upper 20 and sole structure 30. In addition to footwear 10, illusionary structure 40 may also be incorporated into other forms of apparel (i.e., shirts, hats, pants, shorts, etc.) and various types of athletic equipment. Accordingly, the configuration of illusionary structure 40 and the manner in which illusionary structure 40 is incorporated into articles may vary considerably within the scope of the present invention.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of footwear comprising an upper for receiving a foot and a sole structure secured to the upper, at least one of the upper and the sole structure having an exterior surface and a reverse perspective structure formed in the exterior surface, the reverse perspective structure having a three-dimensional configuration with:

a first edge and a second edge of different length that form a first misleading depth cue; and converging perspective line edges that form a second misleading depth cue, wherein the first edge and the second edge form opposite sides of a surface, the perspective line edges extend between the first edge and the second edge to also form opposite sides of the surface, and the reverse perspective structure includes two of the surface, the two of the surface being arranged in an abutting configuration that forms the second edge.

2. The article of apparel recited in claim 1, wherein the perspective line edges have first ends and second ends, the first ends being located closer to the interior of the article than the second ends, and the first ends have a greater spacing than the second ends.

3. The article of footwear recited in claim 2, wherein the first edge is located closer to an interior of the article of footwear than the second edge, and the first edge has a greater length than the second edge.

4. The article of footwear recited in claim 1, wherein the surface has a trapezoidal shape.

5. The article of footwear recited in claim 1, wherein the surface is angled with respect to the exterior surface.

6. The article of footwear recited in claim 1, wherein the reverse perspective structure includes a pair of triangular surfaces, the triangular surfaces being arranged in an abutting configuration with opposite sides of the two of the surface to form the perspective line edges.

7. The article of footwear recited in claim 1, wherein a plurality of the reverse perspective structure are positioned side-by-side along a length of the sole structure.

8. An article of footwear comprising an upper for receiving a foot and a sole structure secured to the upper, at least one of the upper and the sole structure having an exterior surface and a reverse perspective structure formed in the exterior surface, the reverse perspective structure including:

a plurality of indentations defined by the sidewall, at least one of the indentations forming a pair of surfaces that extend into the sidewall;

a first vertical edge and a second vertical edge positioned on opposite sides of each of the pair of surfaces, the first vertical edge being longer than the second vertical edge, and the first vertical edge being common to both surfaces; and at least a first perspective line edge and a non-parallel second perspective line edge extending between the first vertical edge and the second vertical edge, a distance between the first perspective line edge and the second perspective line edge increasing as the first perspective line edge and the second perspective line edge extend into the indentations and toward the first vertical edge.

9. The article of footwear recited in claim 8, wherein the pair of surfaces have trapezoidal shapes.

10. The article of footwear recited in claim 8, wherein the pair of surfaces are angled with respect to the exterior surface.

11. The article of footwear recited in claim 8, wherein the first vertical edge and the second vertical edge form a first misleading depth cue, and the first perspective line edge and the second perspective line edge form a second misleading depth cue.

12. The article of footwear recited in claim 8, wherein the at least one of the indentations also forms a pair of triangular surfaces that abut the first perspective line edge and the second perspective line edge.

13. An article of footwear comprising an upper for receiving a foot and a sole structure secured to the upper, at least one of the upper and the sole structure having an exterior surface including:

a first surface and a second surface that are angled with respect to each other, each of the first surface and the second surface having a trapezoidal shape;

a first long edge and a second long edge, the first long edge extending vertically along a side of the first surface, and the second long edge extending vertically along a side of the second surface;

a short edge that is parallel to the first lang edge and the second long edge, the short edge being positioned between the first long edge and the second long edge, and the short edge forming an abutting interface between the first surface and the second surface;

a first pair of perspective line edges extending along upper and lower portions of the first surface, the first pair of perspective line edges extending between end points of the first long edge and the short edge, and the first pair of perspective line edges converging between the first long edge and the short edge;

a second pair of perspective line edges extending along upper and lower portions of the second surface, the second pair of perspective line edges extending between end points of the second long edge and the short edge, and the second pair of perspective line edges converging between the first long edge and the short edge.

14. The article of footwear recited in claim 13, further including a first triangular surface and a second triangular surface, the first triangular surface abutting the upper portions of each of the first surface and the second surface, and the second triangular surface abutting the lower portions of each of the first surface and the second surface.

15. The article of footwear recited in claim 13, wherein the first long edge, the second long edge, the short edge, the first pair of perspective line edges, and the second pair of perspective line edges form a reverse perspective structure.

16. The article of footwear recited in claim 15, wherein the article of footwear includes a plurality of the reverse perspective structure positioned side-by-side.

17. The article of footwear recited in claim 13, wherein the first long edge, the second long edge, and the short edge form a first misleading depth cue, and the first pair of perspective line edges and the second pair of perspective line edges form a second misleading depth cue.

18. An article of footwear comprising an upper for receiving a foot and a sole structure secured to the upper, at least one of the upper and the sole structure having an exterior surface that defines a three-dimensional structure with a pair of trapezoidal surfaces and a pair of triangular surfaces, each of the trapezoidal surfaces having a pair of parallel sides that include a tong edge and a short edge, the short edge from each trapezoidal surface forming a vertex of the structure.

19. The article of footwear recited in claim 18, wherein the three-dimensional structure forms a reverse perspective structure.

20. The article of footwear recited in claim 18, wherein the long edge is located closer to an interior of the article of footwear than the short edge.

21. The article of footwear recited in claim 18, wherein each of the trapezoidal surfaces have a pair of non-parallel sides, and the triangular surfaces abut the trapezoidal surfaces at the non-parallel sides.

22. The article of footwear recited in claim 21, wherein the long edge and the short edge form a first misleading depth cue, and the non-parallel sides form a second misleading depth cue.

23. The article of footwear recited in claim 18, wherein a plurality of the three dimensional structure are located side-by-side.

24. An article of footwear having an upper for receiving a foot and a sole structure secured to the upper, the sole structure comprising:

an exposed sidewall that defines a plurality of wedge-shaped indentations extending into the sidewall, at least a portion of the indentations forming a pair of surfaces that are angled relative to each other;

a plurality of first perspective line edges joined end-to-end to form a zig-zag shape having a plurality of first vertices;

a plurality of second perspective line edges joined end-to-end to form another zig-zag shape having a plurality of second vertices, the second perspective lines being positioned below the first perspective lines;

a plurality of long edges extending vertically between a portion of the first vertices and the second vertices, the long edges being positioned within the indentations; and a plurality of short edges extending vertically between another portion of the first vertices and the second vertices, the short edges being located closer to an exterior of the article of footwear than the long edges.

25. An article of equipment having an exterior surface comprising:

a first surface and a second surface that are angled with respect to each other, each of the first surface and the second surface having a trapezoidal shape;

a first long edge and a second long edge, the first long edge extending vertically along a side of the first surface, and the second long edge extending vertically along a side of the second surface;

a short edge that is parallel to the first long edge and the, second long edge, the short edge being positioned between the first long edge and the second long edge, and the short edge forming an abutting interface between the first surface and the second surface;

a first pair of perspective line edges extending along upper and lower portions of the first surface, the first pair of perspective line edges extending between end points of the first long edge and the short edge, and the first pair of perspective line edges converging between the first long edge and the short edge;

a second pair of perspective line edges extending along upper and lower portions of the second surface, the second pair of perspective line edges extending between end points of the second long edge and the short edge, and the second pair of perspective line edges converging between the first long edge and the short edge.

26. The article of equipment recited in claim 25, further including a first triangular surface and a second triangular surface, the first triangular surface abutting the upper portions of each of the first surface and the second surface, and the second triangular surface abutting the lower portions of each of the first surface and the second surface.

27. The article of equipment recited in claim 25, wherein the first long edge, the second long edge, the short edge, the first pair of perspective line edges, and the second pair of perspective line edges form a reverse perspective structure.

28. The article of equipment recited in claim 27, wherein the article of equipment includes a plurality of the reverse perspective structure positioned side-by-side.

29. The article of equipment recited in claim 25, wherein the first long edge, the second long edge, and the short edge form a first misleading depth cue, and the first pair of perspective line edges and the second pair of perspective line edges form a second misleading depth cue.

* * * * *